US006459361B1

(12) United States Patent
Kajimura

(10) Patent No.: US 6,459,361 B1
(45) Date of Patent: Oct. 1, 2002

(54) RADIO SIGNAL SELECTIVE CALLING RECEIVER AND METHOD OF DISPLAYING MESSAGE IN THE SAME

(75) Inventor: Hideki Kajimura, Shizuoka (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/393,020

(22) Filed: Sep. 9, 1999

(30) Foreign Application Priority Data

Sep. 9, 1998 (JP) ..... 10-254774

(51) Int. Cl.[7] ..... G08B 5/22

(52) U.S. Cl. ..... 340/7.56; 340/7.2; 340/7.51; 340/7.52; 340/7.47; 340/7.55; 340/7.56

(58) Field of Search ..... 340/7.56, 7.52, 340/7.2, 7.43, 7.45, 7.47, 7.51, 7.48, 7.55, 7.57

(56) References Cited

U.S. PATENT DOCUMENTS 4,870,402 A * 9/1989 Deluca et al. ..... 340/825.44
5,784,001 A * 7/1998 Deluca et al. ..... 340/825.44
5,828,313 A * 10/1998 Mochizuki ..... 340/825.44

FOREIGN PATENT DOCUMENTS

JP 64-55670 3/1989
JP 7-298327 11/1995
JP 8-500709 1/1996
JP 8-501432 2/1996
JP 8-504077 4/1996
JP 8-317438 11/1996
JP 9-146938 6/1997
JP 10-66124 3/1998
JP 10-98544 4/1998

* cited by examiner

*Primary Examiner*—Donnie L. Crosland
(74) *Attorney, Agent, or Firm*—Young & Thompson

(57) ABSTRACT

There is provided a radio signal selective-calling receiver including (a) a display screen on which information are to be displayed, (b) a first memory for storing therein the information in the form of letters, and (c) a controller which, when the information is contained in a received signal, stores the information in the first memory and displays the information on the display screen in the form of a combination of letters and pictures, and which, when the information is not contained in a received signal, reads the information out of the first memory, converts the information into a combination of letters and pictures which combination can be displayed in one line on the display screen, and displays the thus converted combination of letters and pictures on the display screen. In accordance with the radio signal selective-calling receiver, when only one information is displayed on a display screen among a plurality of information, it is possible to shorten information by using pictorial symbols, and widen an area in a display screen for displaying information.

38 Claims, 7 Drawing Sheets

RADIO SIGNAL SELECTIVE CALLING RECEIVER AND METHOD OF DISPLAYING MESSAGE IN THE SAME

BACKGROUND OF THE INVENTION

1. Field of the Invention

The invention relates to a radio signal selective-calling receiver which receives both individual calling message transmitted from other users (hereinafter, referred to simply as "individual calling information") and information transmitted from a radio signal communication company (hereinafter, referred to simply as "common information"), and has a memory to store individual calling information and common information therein, and more particularly to such a radio signal selective-calling receiver which shortens long received information by using pictorial symbols when detailed information is to be obtained from received information or information having been already stored in a memory, and which can provide detailed information about any one of words or items in received information.

2. Description of the Related Art

These times, a radio signal selective-calling receiver has been requested to transmit or receive message including pictorial symbols, Chinese characters, alphabet, Japanese kana, figures, symbols and the like. In addition, message tends to become long.

In contrast, a radio signal selective-calling receiver is requested to be fabricated in a smaller size and in a smaller weight. Accordingly, a display screen in which received message is to be displayed cannot avoid having a smaller area. As a result, when long message is to be displayed on a display screen, it is unavoidable that message cannot be entirely displayed in a display screen, that is, message is partially out of a display screen.

In order to solve this problem, Japanese Unexamined Patent Publication No. 10-66124 has suggested a radio signal selective-calling receiver which enlarges an area of a liquid crystal display (LCD) without altering control ability of LCD driver, when long message is to be displayed.

In the suggested radio signal selective-calling receiver, a display area is divided into a first area and a second area. In dependence on a volume of message included in a received radio signal, the first area is enlarged into the second area to thereby entirely display the message.

Japanese Unexamined Patent Publication No. 8-317438 has suggested a radio signal selective-calling receiver including a colored LCD in order for a user to readily see pictorial information without enlarging an area of a display screen and reducing an area in which message is to be displayed. In the suggested radio signal selective-calling receiver, lines of letters are displayed in blue and pictorial information is displayed in red as a background in a display screen.

Japanese Unexamined Patent Publication No. 8-501432, which was filed as the international patent application PCT/US94/06283 and published as WO95/02305, and which was based on the U.S. patent application Ser. No. 08/086,065, has suggested an interactive affirmative responsive pager comprised of a widely used information communication terminal such as a portable wireless communication terminal.

Japanese Unexamined Patent Publication No. 8-500709, which was filed as the international patent application PCT/US93/06741 and published as WO94/06241, and which was based on the U.S. patent application Ser. No. 07/937,085, has suggested a wireless communication system in which information input by a user is encoded, and the thus encoded information is transmitted and received in the form of a wireless communication signal.

Japanese Unexamined Patent Publication No. 8-504077, which was filed as the international patent application PCT/US95/00999 and published as WO95/21501, and which was based on the U.S. patent application Ser. No. 08/191,897, has suggested a radio signal selective-calling receiver which is used as a fax machine.

There have been developed various radio signal selective-calling receivers, as mentioned earlier. They are all requested to receive and display common information, as well as individual calling information, provided from a radio signal communication company. Herein, common information includes news, weather report, and results of sport games, for instance.

However, the number and kinds of information has been recently increased, and in addition, a greater and greater volume of data has been included in one information. As a result, such information cannot be entirely displayed in a display screen of a conventional radio signal selective-calling receiver, which causes a problem that it is quite difficult for a user to find and select requisite information.

SUMMARY OF THE INVENTION

In view of the above-mentioned problem, it is an object of the present invention to provide a radio signal selective-calling receiver which is capable of shortening information by using pictorial symbols, and widen an area in a display screen for displaying information, when only one information is displayed on a display screen among a plurality of information, and providing a detail of items included in received information.

It is also an object of the present invention to provide a method of displaying message in a radio signal selective-calling receiver, which method is capable of doing the same.

In one aspect of the present invention, there is provided a radio signal selective-calling receiver including (a) a display screen on which information is to be displayed, (b) a first memory for storing therein the information in the form of letters, and (c) a controller which, when the information is contained in a received signal, stores the information in the first memory and displays the information on the display screen in the form of a combination of letters and pictures, and which, when the information is not contained in a received signal, reads the information out of the first memory, converts the information into a combination of letters and pictures which combination can be displayed in one line on the display screen, and displays the thus converted combination of letters and pictures on the display screen.

For instance, information is comprised of individual calling information and common information.

It is preferable that the radio signal selective-calling receiver further includes (d) a second memory in which calling numbers are stored therein, and (e) an annunciator which annunciates a user that there has been a call, in which case, the controller compares an address signal included in a received signal to the calling numbers, and drives the annunciator when the address signal is coincident with one of the calling numbers.

It is preferable that the radio signal selective-calling receiver further includes a waveform shaping circuit which shapes a waveform of a received signal, a waveform-shaped signal being received in the controller.

It is preferable that the first memory stores therein the individual calling information in the form of alphabets and foreign-language letters.

It is preferable that the first memory stores therein private information including at least a picture, a map, an address and a telephone number.

It is preferable that the radio signal selective-calling receiver further includes a third memory storing therein at least one display table in accordance with which received message is displayed in the display screen in the form of letters and/or pictures.

It is also preferable that the radio signal selective-calling receiver further includes a table indicator which indicates one display table to be used for displaying received message on the display screen.

For instance, the table indicator may be controlled by the controller.

It is preferable that the display table converts the information in the form of letters into information in the form of a combination of letters and pictures, and displays the thus converted information in one line on the display screen.

It is preferable that the display table displays a plurality of information on the display screen so that each information is displayed in a line.

It is preferable that information selected by a cursor among the plurality of information is displayed on the display screen.

It is preferable that the radio signal selective-calling receiver further includes a scroller which scrolls information on the display screen, in which case, it is preferable that the controller displays the thus scrolled information in the form of letters.

It is preferable that the controller displays a detail of any one of items included in information displayed on the display screen.

It is preferable that the controller reads the detail out of the first memory in association with a selected item, and displays the thus read-out detail on the display screen.

It is preferable that the controller, if selected information includes an item having detailed information, displays pictures in front of and/or at the rear of the item.

It is preferable that the controller displays the pictures or both the item and the pictures in an inverted color, when they are selected.

There is further provided a radio signal selective-calling receiver including (a) a display screen on which information is to be displayed, (b) a first memory for storing therein the information in the form of letters, (c) a controller which, when the information is contained in a received signal, stores the information in the first memory and displays the information on the display screen in the form of a combination of letters and pictures, and, when the information is not contained in a received signal, reads the information out of the first memory, converts the information into a combination of letters and pictures which combination can be displayed in one line on the display screen, and displays the thus converted combination of letters and pictures on the display screen, and which displays a detail of any one of items included in the information, and (d) a pass number comparator which compares a pass number input by a user to a predetermined pass number.

It is preferable that the controller displays a detail of any one of items included in the information only when the pass number input by a user is coincident with the predetermined pass number.

In another aspect of the present invention, there is provided a method of displaying message in a radio signal selective-calling receiver, including the steps of (a) receiving a radio signal, (b) checking whether the thus received radio signal contains predetermined information, and (c) displaying the predetermined information in the form of a combination of letters and pictures, if the radio signal contains the predetermined information, and converting the predetermined information into a combination of letters and pictures which combination can be displayed in one line on the display screen, and displays the thus converted combination of letters and pictures on the display screen, if the radio signal does not contain the predetermined information.

It is preferable that the method further includes the steps of comparing an address signal included in a received signal to predetermined calling numbers, and annunciating a user that there is call, when the address signal is coincident with one of the calling numbers.

It is preferable that the method further includes the step of selecting a display table in accordance with which received message is displayed in the form of letters and/or pictures.

It is preferable that the step further includes the step of scrolling information and displaying the thus scrolled information in the form of letters.

It is preferable that the method further includes the step of displaying a detail of any one of items included in displayed information.

It is preferable that the method further includes the step of displaying pictures in front of and/or at the rear of the item.

It is preferable that the method further includes the steps of comparing a pass number input by a user to a predetermined pass number, and displaying a detail of any one of items included in displayed information only when the pass number input by a user is coincident with the predetermined pass number.

The advantages obtained by the aforementioned present invention will be described hereinbelow.

In the radio signal selective-calling receiver in accordance with the present invention, when the controller receives a radio signal, the controller compares an address of the thus received radio signal to calling numbers stored in the first memory. When the address is coincident with one of the calling numbers, and further when the received signal includes individual calling information and/or common information, the controller stores them in the first memory, and further displays them on the display screen in the form of a combination of letters and pictures.

When the received signal does not include individual calling information and/or common information, the controller reads individual calling information and/or common information out of the first memory. Then, the controller converts the thus read-out information into a combination of letters and pictures so that the combination can be displayed in one line on the display screen, and displays the thus converted combination of letters and pictures on the display screen.

In accordance with the present invention, it is possible to shorten information by using pictures or pictorial symbols, and widen an area in a display screen for displaying information.

In addition, the radio signal selective-calling receiver provides a detail of items included in information indicated by a received signal, and displays such a detail for a selected item on the display screen. Hence, a user can readily understand a summary of long information, and can know details of any items included in information.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Figure 1:
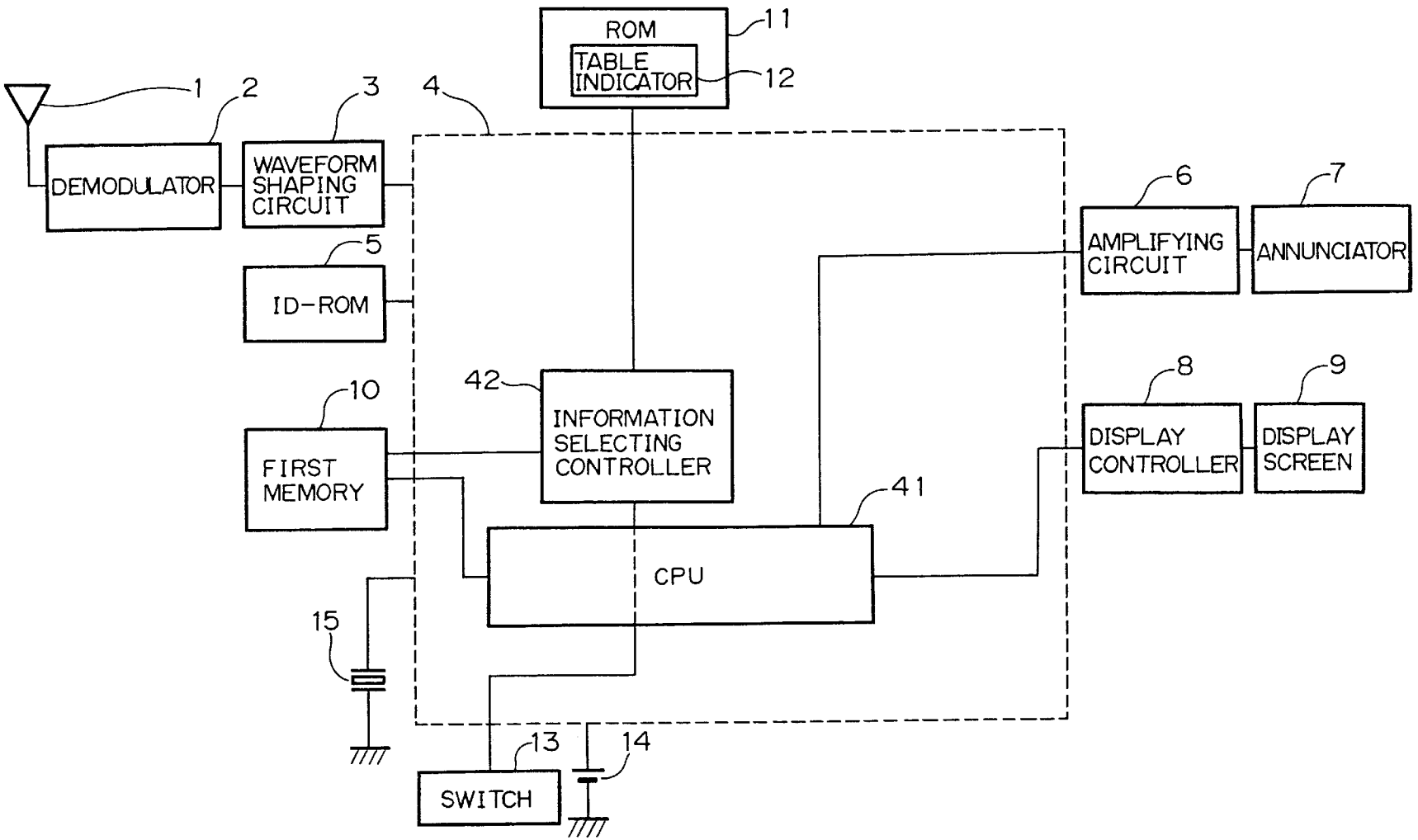
FIG. 1 is a block diagram of a radio signal selective-calling receiver in accordance with the first embodiment of the present invention.

FIG. 1 is a block diagram of a radio signal selective-calling receiver in accordance with the first embodiment.

The radio signal selective-calling receiver is comprised of an antenna 1, a demodulator 2 electrically connected to the antenna 1, a waveform shaping circuit 3 electrically connected to the demodulator 2, a controller 4, a first memory 10, a rewritable ID-ROM 5 as a second memory, ROM 11 as a third memory, a table indicator 12 included in ROM 11, a switch 13, a power source 14, a clock generator 15, an amplifying circuit 6, an annunciator 7 electrically connected to the amplifying circuit 6, a display controller 8, and a display screen 9 controlled by the display controller 8.

The first memory 10, ID-ROM 5, ROM 11, the switch 13, the power source 14, the clock generator 15, the amplifying circuit 6, and the display controller 8 are all electrically connected to the controller 4.

The controller 4 is comprised of a central processing unit (CPU) 41 and an information selecting controller 42. The first memory 10, the amplifying circuit 6, and the display controller 8 are controlled by CPU 41. The first memory 10, the table indicator 12, and the switch 13 are electrically connected to the information selecting controller 42.

A radio signal received in the antenna 1 is amplified and demodulated in the demodulator 2. The thus demodulated signal is converted in the waveform shaping circuit 3 into a signal controllable by the controller 4.

The controller 4 controls an operation of the radio signal selective calling receiver in accordance with an operation program stored in ROM 11.

A plurality of calling numbers is in advance written into the rewritable ID-ROM 5. The controller 4 compares the calling numbers to an address signal included in a signal having been wave-form shaped and then transmitted to the controller 4. When the address signal is coincident with one of the calling numbers, the controller 4 causes the amplifying circuit 6 to drive the annunciator 7 to thereby let a user know that there has been a call.

The controller 4 simultaneously causes the display controller 8 to display individual calling information and common information on the display screen 9.

The first memory 10 in the first embodiment is comprised of a random access memory (RAM). The first memory 10 stores received individual calling information and common information in the form of letters, and stores pictorial symbols, a map, and private information such as an address and a telephone number in the form as they are. The first memory 10 transmits such information to the controller 4, when requested.

The third memory or ROM 11 reads out information stored in the controller 4, and is equipped with the table indicator 12 which selects one of display tables A, B and C. As mentioned later, received information is displayed on the display screen 9 in the form of letters, pictures or pictorial symbols, or a combination thereof.

The information selecting controller 42 in the controller 4 indicates a change among the display tables A, B and C.

Hereinbelow is explained an operation of the radio signal selective-calling receiver in accordance with the first embodiment, with reference to FIG. 2.

First, the radio signal selective-calling receiver is in a stand-by condition in step A1.

When the radio signal selective-calling receiver receives individual calling information or common information (YES in step A2), the controller 4 stores the received information in the first memory 10 in the form of letters in step A3. For instance, if received information contains Japanese-language information, it is stored in the first memory 10 in the form of Japanese kana and Chinese characters. The controller 4 further causes the display controller 8 to display the received information on the display screen 9 in the form of letters in step A4, as illustrated in the display table A (see FIG. 3).

Hence, a user can confirm the received information on the display screen 9 in step A5.

When the radio signal selective-calling receiver does not receive individual calling information or common information (NO in step A2) and information having been already stored in the first memory 10 is to be reconfirmed (YES in step A6), a user inputs a command into the controller 4 through the switch 13, and as a result, a plurality of information is read out of the first memory 10. Then, the information selecting controller 42 drives the table indicate or 12 to thereby convert information which is in the form of letters into information which is in the form of a combination of letters and pictorial symbols in step A7. In addition, the controller 41 controls the display controller 8 to thereby display the information on the display screen 9 is that each of a plurality of information is displayed in one line, as illustrated in the display table B in FIG. 3.

Then, a user selects one of a plurality of information displayed on the display screen 9 for confirmation through the use of a cursor (not illustrated) in step A9.

If information which a user intends to confirm is not displayed on the display screen, information displayed on the display screen 9 is scrolled by means of the switch 13 in step A10 to thereby display requisite information on the display screen 9.

Figure 3:
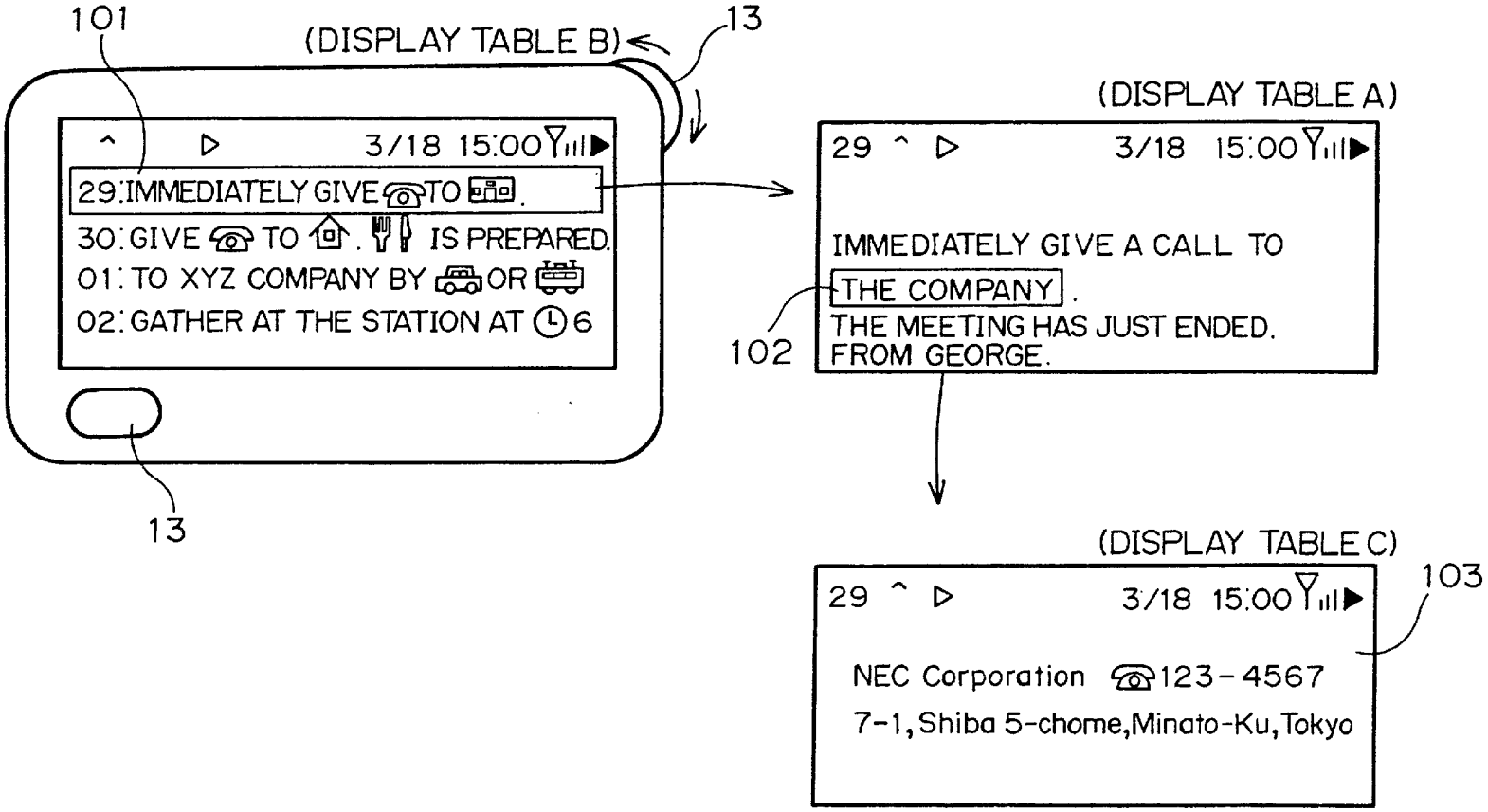
FIG. 3 illustrates display tables used in the radio signal selective-calling receiver illustrated in FIG. 1.

The thus selected information is converted into information which is in the form of letters in step All, as illustrated in the display table A in FIG. 3. The thus converted information is displayed on the display screen 9 in step A12.

When a user would like to know a detail about an item included in the received or selected information (YES in step A13), a user moves a cursor on the display screen 9 through the switch 13 to thereby select one item included in information displayed on the display screen 9 in step A14.

The controller 4 reads a detail out of the first memory 10 in association with the thus selected item in step A15, and displays the thus read-out detail on the display screen 9 in step A16, as illustrated in the display table C in FIG. 3. Thus, a user can confirm requisite information in step A17.

A detailed example of the display tables A, B and C is illustrated in FIG. 3.

When requisite information is read out among information having been stored in the first memory 10, a user moves a cursor by means of the switch 13 to thereby select one information among a plurality of information which is displayed on the display screen 9 and which is in the from of a combination of pictorial symbols and letters in accordance with the display table B. For instance, a user selects a message 101 in an italic form, indicating "Immediately give a call to the company". In the message 101, a call is represented in a pictorial symbol meaning a telephone, and the company is represented also in a pictorial symbol meaning an office.

When the message 101 is selected in the above-mentioned manner, the message 101 is displayed in the form of letters on the display screen 9 in accordance with the display table A. That is, the message 101 is displayed as "Immediately give a call to the company. The meeting has just ended. From George".

If a user would like to know a detail about an item in the message 101, it is necessary for a user to select the item by moving a cursor onto the item. Herein, it is assumed that a user selects an item 102 indicative of "the company".

Then, the thus selected item 102 is converted into an associated detail in accordance with the display table C. That is, as illustrated in FIG. 3, a detail 103 associated with the item 102 is displayed on the display screen 9. Herein, the detail 103 indicates the company's name "NEC Corporation", a telephone number of the company, and an address of the company, in which a telephone is represented in a pictorial symbol.

As mentioned above, in accordance with the first embodiment, when a user selects requisite information among a plurality of information displayed on the display screen 9, the selected information is displayed in the form of a combination of letters and pictorial symbols. Hence, it is possible to shorten information by using pictures or pictorial symbols, and widen an area in the display screen 9 for displaying information.

In addition, a detail of items included in information displayed on the display screen 9 is provided. Such a detail for a selected item is displayed on the display screen 9. Hence, a user can readily understand a summary of long information, and can know details of any items included in information.

Figure 4:
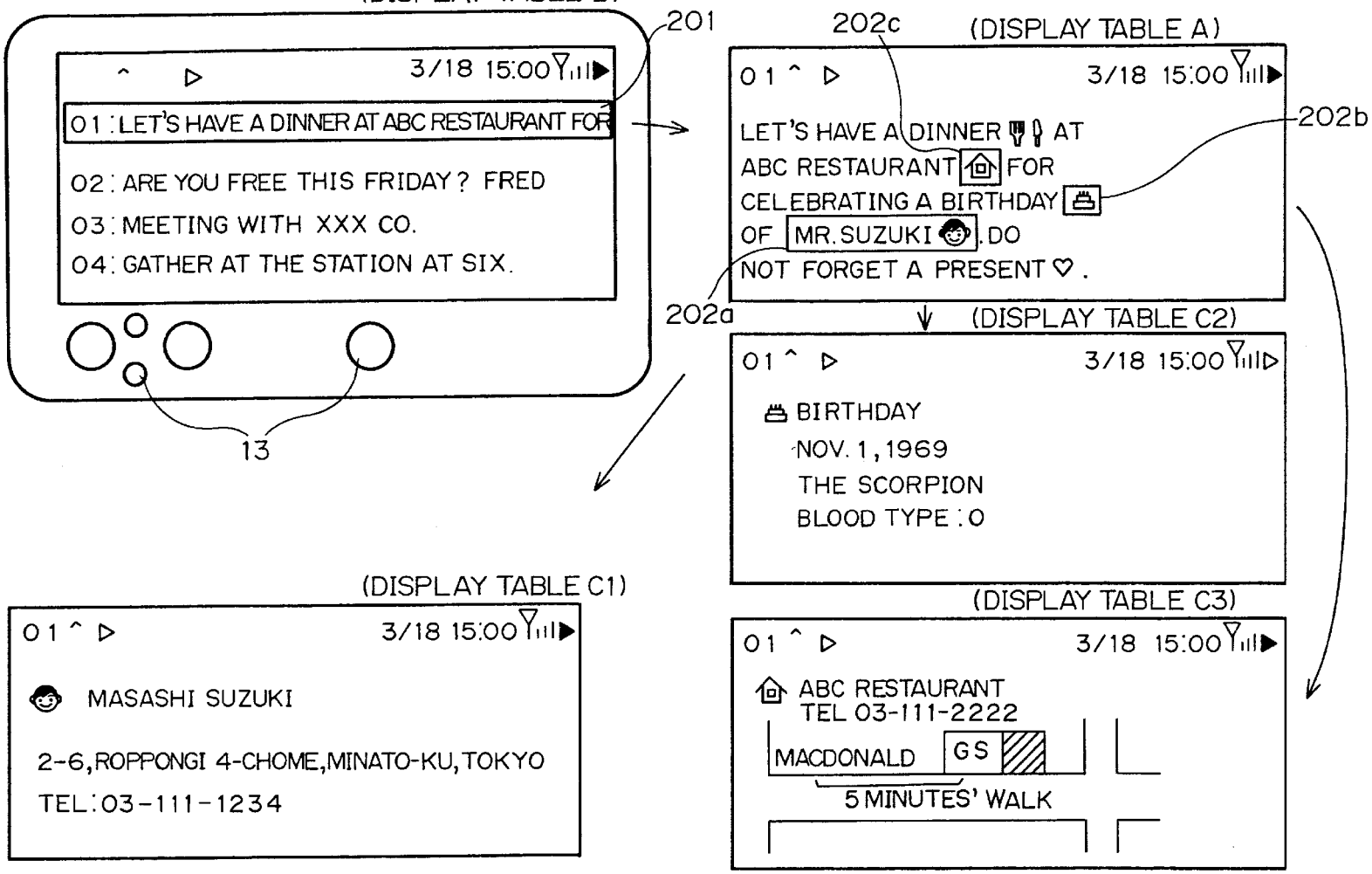
FIG. 4 illustrates display tables used in the radio signal selective-calling in accordance with the second embodiment of the present invention.

FIG. 4 illustrates the display tables A, B and C to be used in the radio signal selective-calling receiver in accordance with the second embodiment.

When requisite information is read out among information having been stored in the first memory 10, a user moves a cursor by means of the switch 13 to thereby select one information among a plurality of information which is displayed on the display screen 9 and which is in the from of a combination of pictorial symbols and letters in accordance with the display table B. For instance, a user selects a message 201 in an italic form, indicating "Let's have a dinner at ABC restaurant for celebrating a birthday of Mr. Suzuki".

When the message 201 is selected in the above-mentioned manner, the message 201 is displayed in the form of letters on the display screen 9 in accordance with the display table A. That is, the message 201 is displayed as "Let's have a dinner at ABC restaurant for celebrating a birthday of Mr. Suzuki. Do not forget a present.".

In the display table A in the second embodiment, if items in the selected message 201 have a detail, the items are displayed on the display screen 9 with a pictorial symbol being located in front of or at the rear of each of the items.

If a user would like to know a detail about an item in the message 201, it is necessary for a user to select the pictorial symbol associated with the item or both the pictorial symbol and the item by moving a cursor onto the item.

Herein, it is assumed that a user selects items 202*a*, 202*b* and 202*c* in the selected message 201.

The thus selected item 202*a* is converted into an associated detail in accordance with the display table C1. That is, as illustrated in FIG. 4, a detail associated with the item 202*a* is displayed on the display screen 9, indicating a full name of Mr. Suzuki, and an address and a telephone number of Mr. Suzuki. This information is stored in the first memory 10 by a user.

The selected item 202*b* is converted into an associated detail in accordance with the display table C2. That is, as illustrated in FIG. 4, a detail associated with the item 202*b* is displayed on the display screen 9, indicating a birthday, a constellation, and a blood type of Mr. Suzuki. This information is stored in the first memory 10 by a friend of a user.

The selected item 202*c* is converted into an associated detail in accordance with the display table C3. That is, as illustrated in FIG. 4, a detail associated with the item 202*c* is displayed on the display screen 9, indicating a telephone of ABC restaurant and a map around ABC restaurant. This information is stored in the first memory 10 by a third party.

As is obvious in view of FIG. 4, it is possible to store a figure, a sentence, a picture, a map and other pictorial symbols in the first memory 10, and display them on the display screen 9. However, it should be noted that only common information which has been already stored can be displayed, if information to be displayed is not one having been stored by a user itself.

Figure 5:
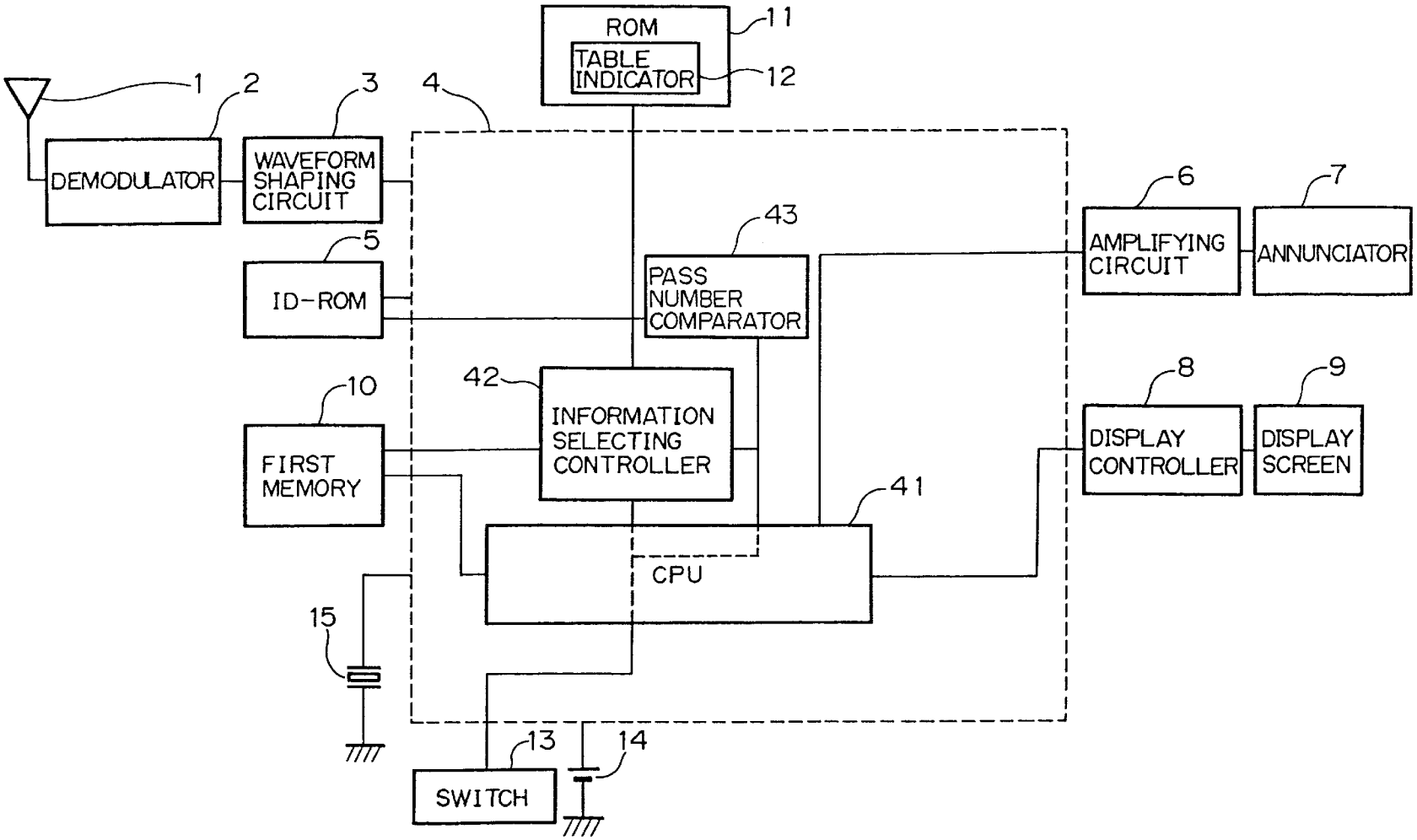
FIG. 5 is a block diagram of a radio signal selective-calling receiver in accordance with the second embodiment of the present invention.
Figure 6:
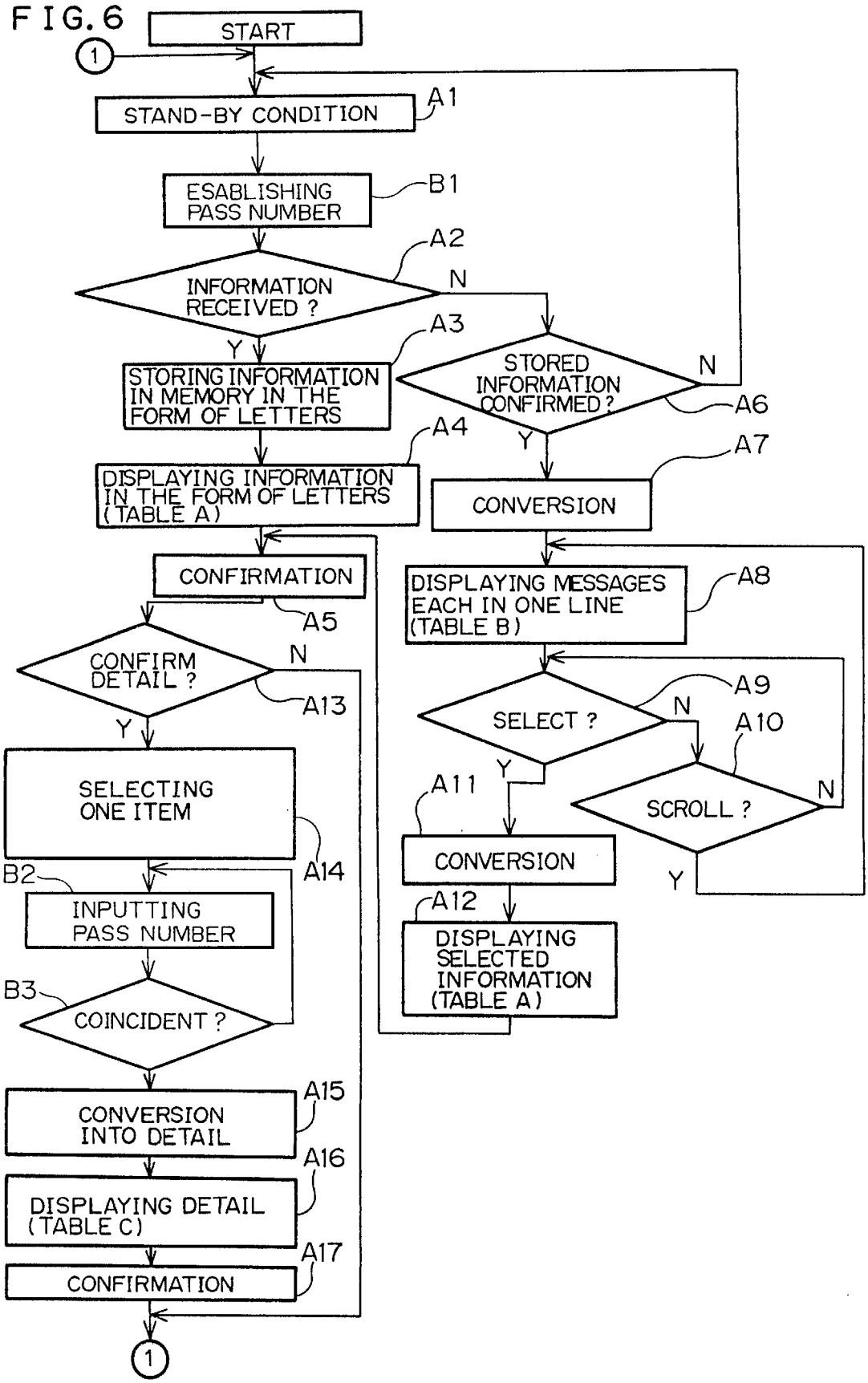
FIG. 6 is a flow chart of an operation of the radio signal selective-calling receiver illustrated in FIG. 5.

FIG. 5 is a block diagram of a radio signal selective-calling receiver in accordance with the second embodiment, and FIG. 6 is a flow chart of an operation of the radio signal selective-calling receiver.

In the radio signal selective-calling receiver in accordance with the second embodiment, a pass number has to be input into the controller 4 for security, when a detail of an item included in information is to be read out in accordance with the display table C.

The radio signal selective-calling receiver in accordance with the second embodiment is structurally different from the radio signal selective-calling receiver in accordance with the first embodiment in that the controller 4 includes a pass number comparator 43. Parts or elements that correspond to those of the radio signal selective-calling receiver illustrated in FIG. 1 have been provided with the same reference numerals.

The pass number comparator 43 is electrically connected to ID-ROM 5, the information selecting controller 42, and the switch 13. The pass number comparator 43 is controlled by CPU 41, and establishes a pass number and compares pass numbers to each other.

Hereinbelow is explained an operation of the radio signal selective-calling receiver in accordance with the second embodiment, with reference to FIG. 6. Steps that correspond to those of the flow chart illustrated in FIG. 2 have been provided with the same reference numerals.

While the radio signal selective-calling receiver is in a stand-by condition in step A1, a pass number is established in the pass number comparator 43 by means of the switch 13 through CPU 41. The thus established pass number is stored in ID-ROM 5 in step B1.

Then, the steps A2, A3, A4, A5 and A13 are carried out in the same manner as the first embodiment.

When a user would like to know a detail of one of items included in information displayed in the display screen 9, a user selects one item in step A14. Thereafter, a user is requested to input the pass number again into the pass number comparator 43 through the switch 13 for comparing to the pass number having been previously stored in ID-ROM 5, in step B2.

Then, the pass number comparator 43 compares the newly input pass number to the pass number having been stored in ID-ROM 5, in step B3.

If those pass numbers are coincident with each other, the controller 4 reads a detail out of the first memory in association with the selected item in accordance with an instruction transmitted from the table indicator 12, and causes the display controller 8 to display the thus read-out detail on the display screen 9 in accordance with the display table C, in step A15.

If those pass numbers are not coincident with each other, the controller 4 causes the display controller 8 to display the previously selected information on the display screen 9 in accordance with the display table A, that is, in the form of letters.

Figure 2:
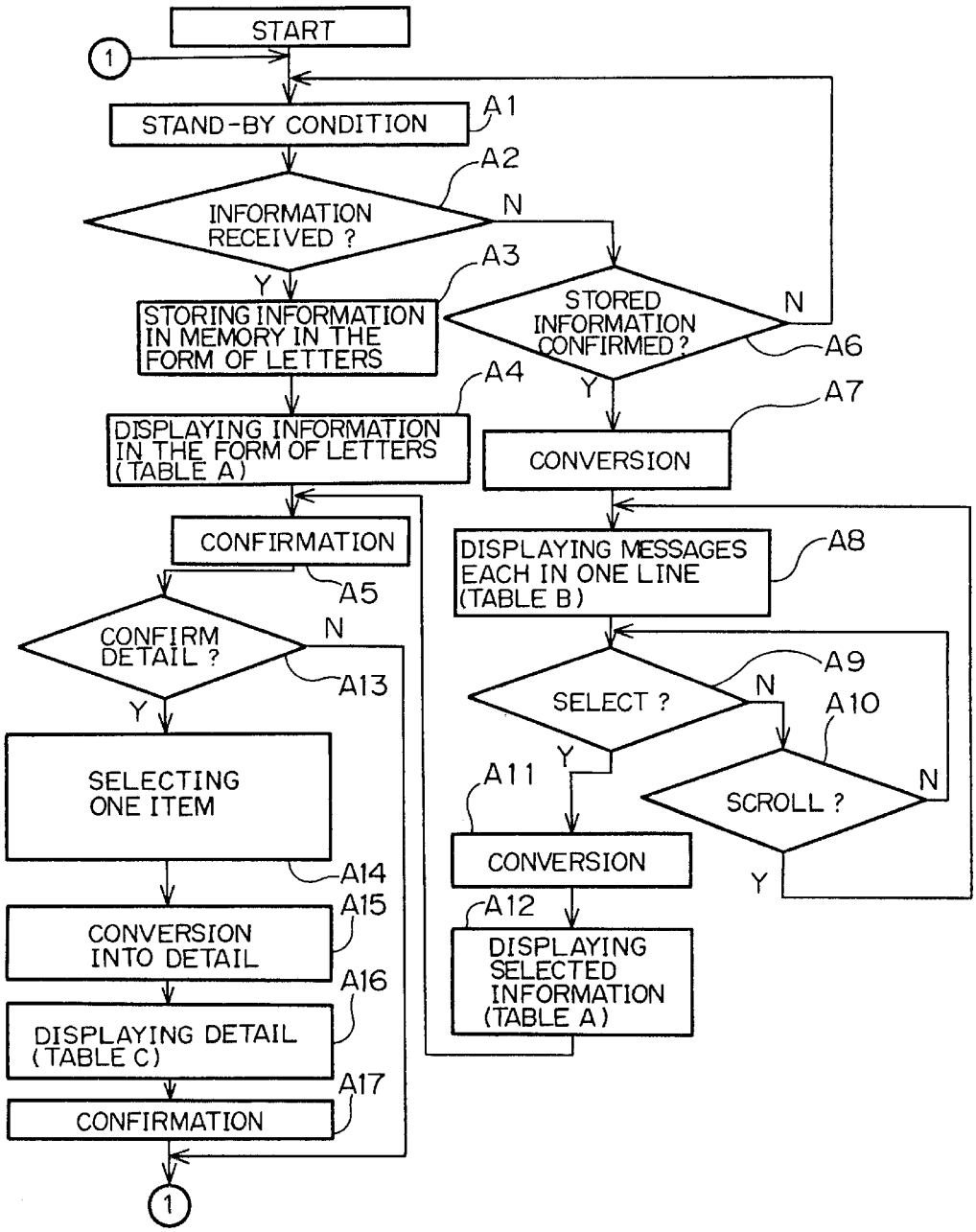
FIG. 2 is a flow chart of an operation of the radio signal selective-calling receiver illustrated in FIG. 1.

Thereafter, the steps A15, A16 and A17 are carried out in the same manner as shown in FIG. 2.

If individual calling information and common data are not received in step A2, the steps A6 to A12, and then, the steps A5 to A17 are carried out in the same manner as shown in FIG. 2.

Figure 7:
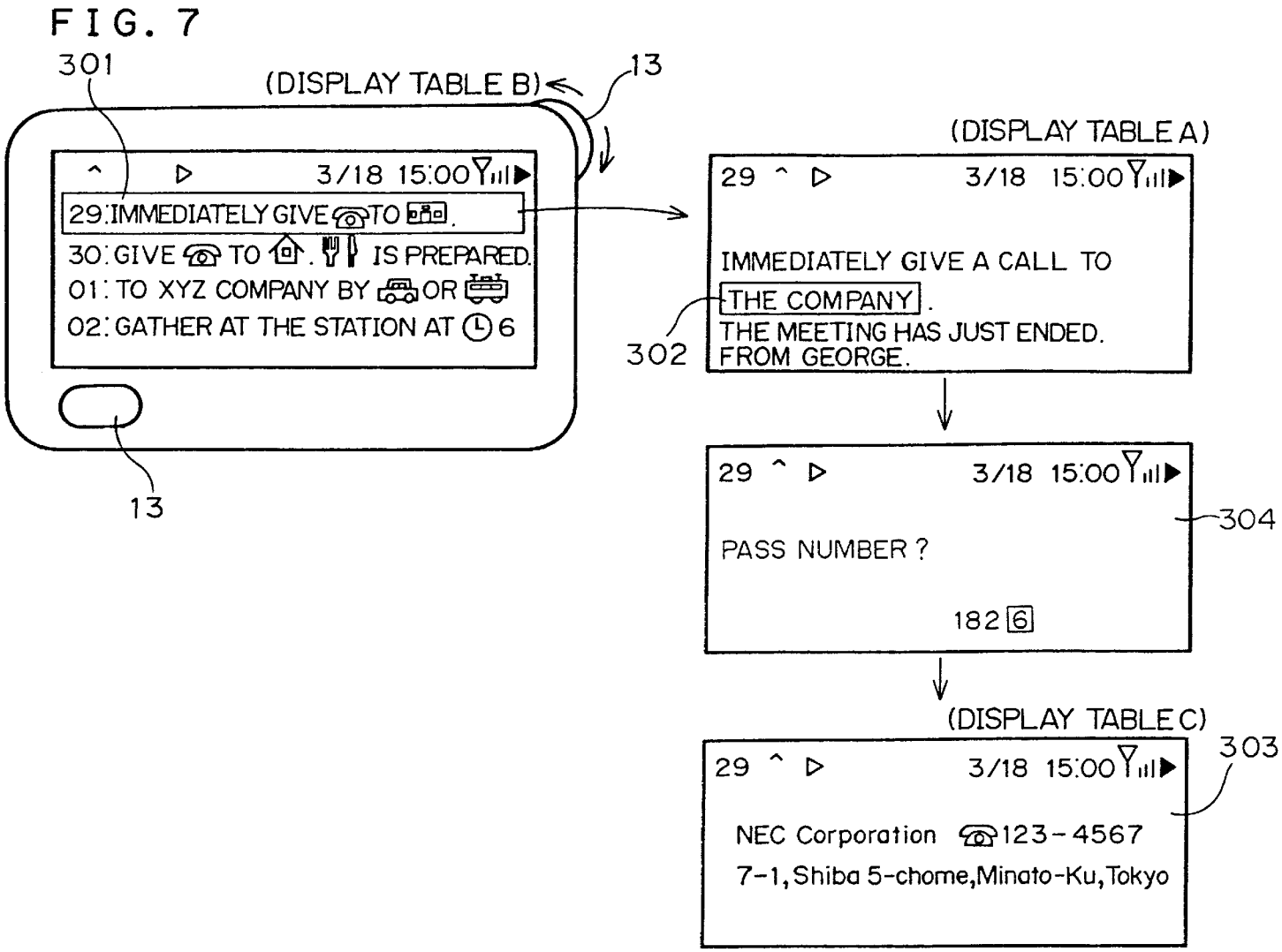
FIG. 7 illustrates display tables used in the radio signal selective-calling receiver illustrated in FIG. 5.

FIG. 7 illustrates the display tables A, B and C to be used in the second embodiment.

On the display screen 9 are displayed a plurality of information in the form of a combination of letters and pictorial symbols in accordance with the display table B. Herein, a message 301 "Immediately give a call to the company" is now selected. In the message 301, a call is represented in a pictorial symbol meaning a telephone, and the company is represented also in a pictorial symbol meaning an office.

The thus selected message 301 is displayed in the form of letters on the display screen 9 in accordance with the display table A, as illustrated in FIG. 7. That is, the message 301 is displayed as "Immediately give a call to the company. The meeting has just ended. From George".

If a user would like to know a detail about an item in the message 301, a user has to select one item by moving a cursor onto the item. Herein, it is assumed that a user selects an item 302 indicative of "the company".

Then, a picture in the display screen 9 is turned into a picture 304 in which a user is requested to input a pass number. The picture 304 is displayed in accordance with the display table A, that is, in the form of letters.

Then, if a user inputs a pass number which is coincident with the pre-established pass number, the thus selected item 302 is converted into an associated detail in accordance with the display table C. That is, as illustrated in FIG. 7, a detail 303 associated with the item 302 is displayed on the display screen 9. Herein, the detail 103 indicates the company's name "NEC Corporation", a telephone number of the company, and an address of the company, in which a telephone is represented in a pictorial symbol.

In FIG. 7, a user has input a number "1826" into the pass number comparator 43. Among the FIGS. 1, 8, 2 and 6 input by the user, only the last FIG. 6 is color-inverted. This means that the pass number is 6.

Thus, if the pass number input by a user is coincident with the pass number previously established by the pass number comparator 43, the detail 303 is displayed on the display screen 9.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 10-254774 filed on Sep. 9, 1998 including specification, claims, drawings and summary is incorporated herein by reference in its entirety.

What is claimed is:

1. A radio signal selective-calling receiver comprising:

(a) a display screen on which information is to be displayed;

(b) a first memory for storing therein said information in the form of letters; and (c) a controller which, when said information is contained in a received signal, stores said information in said first memory and displays said information on said display screen in the form of a combination of letters and pictures, and which, when said information is not contained in a received signal, reads said information out of said first memory, converts said information into a combination of letters and pictures which combination can be displayed in one line on said display screen, and displays the thus converted combination of letters and pictures on said display screen.

2. The radio signal selective-calling receiver as set forth in claim 1, wherein said information is comprised of individual calling information and common information.

3. The radio signal selective-calling receiver as set forth in claim 1, further comprising:

(d) a second memory in which calling numbers are stored therein; and (e) an annunciator which annunciates a user that there has been a call, said controller comparing an address signal included in a received signal to said calling numbers, and driving said annunciator when said address signal is coincident with one of said calling numbers.

4. The radio signal selective-calling receiver as set forth in claim 1, further comprising a waveform shaping circuit which shapes a waveform of a received signal, a waveform-shaped signal being received in said controller.

5. The radio signal selective-calling receiver as set forth in claim 2, wherein said first memory stores therein said individual calling information in the form of alphabets and foreign-language letters.

6. The radio signal selective-calling receiver as set forth in claim 1, wherein said first memory stores therein private information including at least a picture, a map, an address and a telephone number.

7. The radio signal selective-calling receiver as set forth in claim 1, further comprising a third memory storing therein at least one display table in accordance with which received message is displayed in said display screen in the form of letters and/or pictures.

8. The radio signal selective-calling receiver as set forth in claim 7, further comprising a table indicator which indicates one display table to be used for displaying received message on said display screen.

9. The radio signal selective-calling receiver as set forth in claim 8, wherein said table indicator is controlled by said controller.

10. The radio signal selective-calling receiver as set forth in claim 7, wherein said display table converts said information in the form of letters into information in the form of a combination of letters and pictures, and displays the thus converted information in one line on said display screen.

11. The radio signal selective-calling receiver as set forth in claim 10, wherein said display table displays a plurality of information on said display screen so that each information is displayed in a line.

12. The radio signal selective-calling receiver as set forth in claim 11, wherein information selected by a cursor among said plurality of information is displayed on said display screen.

13. The radio signal selective-calling receiver as set forth in claim 1, further comprising a scroller which scrolls information on said display screen, and wherein said controller displays the thus scrolled information in the form of letters.

14. The radio signal selective-calling receiver as set forth in claim 1, wherein said controller displays a detail of any one of items included in information displayed on said display screen.

15. The radio signal selective-calling receiver as set forth in claim 14, wherein said controller reads said detail out of said first memory in association with a selected item, and displays the thus read-out detail on said display screen.

16. The radio signal selective-calling receiver as set forth in claim 1, wherein said controller, if selected information includes an item having detailed information, displays pictures in front of and/or at the rear of said item.

17. The radio signal selective-calling receiver as set forth in claim 16, wherein said controller displays said pictures or both said item and said pictures in an inverted color, when they are selected.

18. A radio signal selective-calling receiver comprising:

(a) a display screen on which information is to be displayed;

(b) a first memory for storing therein said information in the form of letters;

(c) a controller which, when said information is contained in a received signal, stores said information in said first memory and displays said information on said display screen in the form of a combination of letters and pictures, and, when said information is not contained in a received signal, reads said information out of said first memory, converts said information into a combination of letters and pictures which combination can be displayed in one line on said display screen, and displays the thus converted combination of letters and pictures on said display screen, and which displays a detail of any one of items included in said information; and (d) a pass number comparator which compares a pass number input by a user to a predetermined pass number.

19. The radio signal selective-calling receiver as set forth in claim 18, wherein said controller displays a detail of any one of items included in said information only when said pass number input by a user is coincident with said predetermined pass number.

20. The radio signal selective-calling receiver as set forth in claim 18, wherein said information is comprised of individual calling information and common information.

21. The radio signal selective-calling receiver as set forth in claim 18, further comprising:

(d) a second memory in which calling numbers are stored therein; and (e) an annunciator which annunciates a user that there has been a call, said controller comparing an address signal included in a received signal to said calling numbers, and driving said annunciator when said address signal is coincident with one of said calling numbers.

22. The radio signal selective-calling receiver as set forth in claim 18, further comprising a waveform shaping circuit which shapes a waveform of a received signal, a waveform-shaped signal being received in said controller.

23. The radio signal selective-calling receiver as set forth in claim 20, wherein said first memory stores therein said individual calling information in the form of alphabets and foreign-language letters.

24. The radio signal selective-calling receiver as set forth in claim 18, wherein said first memory stores therein private information including at least a picture, a map, an address and a telephone number.

25. The radio signal selective-calling receiver as set forth in claim 18, further comprising a third memory storing therein at least one display table in accordance with which received message is displayed in said display screen in the form of letters and/or pictures.

26. The radio signal selective-calling receiver as set forth in claim 25, further comprising a table indicator which indicates one display table to be used for displaying received message on said display screen.

27. The radio signal selective-calling receiver as set forth in claim 26, wherein said table indicator is controlled by said controller.

28. The radio signal selective-calling receiver as set forth in claim 25, wherein said display table converts said information in the form of letters into information in the form of a combination of letters and pictures, and displays the thus converted information in one line on said display screen.

29. The radio signal selective-calling receiver as set forth in claim 28, wherein said display table displays a plurality of information on said display screen so that each information is displayed in a line.

30. The radio signal selective-calling receiver as set forth in claim 18, wherein said controller, if selected information includes an item having detailed information, displays pictures in front of and/or at the rear of said item.

31. A method of displaying message in a radio signal selective-calling receiver, comprising the steps of:

(a) receiving a radio signal;

(b) checking whether the thus received radio signal contains predetermined information; and (c) displaying said predetermined information in the form of a combination of letters and pictures, if said radio signal contains said predetermined information, and converting said predetermined information into a combination of letters and pictures which combination can be displayed in one line on said display screen, and displays the thus converted combination of letters and pictures on said display screen, if said radio signal does not contain said predetermined information.

32. The method as set forth in claim 31, wherein said information is comprised of individual calling information and common information.

33. The method as set forth in claim 31, further comprising the steps of comparing an address signal included in a received signal to predetermined calling numbers, and annunciating a user that there is call, when said address signal is coincident with one of said calling numbers.

34. The method as set forth in claim 31, further comprising the step of selecting a display table in accordance with which received message is displayed in the form of letters and/or pictures.

35. The method as set forth in claim 31, further comprising the step of scrolling information and displaying the thus scrolled information in the form of letters.

36. The method as set forth in claim 31, further comprising the step of displaying a detail of any one of items included in displayed information.

37. The method as set forth in claim 36, further comprising the step of displaying pictures in front of and/or at the rear of said item.

38. The method as set forth in claim 31, further comprising the steps of comparing a pass number input by a user to a predetermined pass number, and displaying a detail of any one of items included in displayed information only when said pass number input by a user is coincident with said predetermined pass number.

* * * * *